United States Patent [19]

Hoffmann

[11] Patent Number: 4,853,057

[45] Date of Patent: Aug. 1, 1989

[54] METHOD OF MAKING TENNIS BALLS OR THE LIKE

[76] Inventor: Allan C. Hoffmann, 2891 Rumsey Dr., Riverside, Calif. 92506

[21] Appl. No.: 212,197

[22] Filed: Jun. 27, 1988

Related U.S. Application Data

[63] Continuation-in-part of Ser. No. 145,897, Jan. 20, 1988.

[51] Int. Cl.[4] ..... A63B 45/00; A63B 43/00

[52] U.S. Cl. ..... 156/147; 156/145; 156/228; 273/61 R; 273/61 D; 264/545

[58] Field of Search ..... 264/545, 248; 156/145, 156/146, 147, 156, 228, 292; 273/65 C, 61 R, 61 D

[56] References Cited

U.S. PATENT DOCUMENTS

| | | | |
|---|---|---|---|
| Re. 172,000 | 1/1929 | Reach . | |
| 1,146,523 | 7/1915 | Roberts | 156/228 X |
| 1,346,848 | 7/1920 | Roberts . | |
| 1,387,805 | 8/1921 | Roberts | 264/545 X |
| 1,400,146 | 12/1921 | Eggers | 264/545 X |
| 1,423,838 | 7/1922 | Gowin . | |
| 1,531,162 | 3/1925 | Valero . | |
| 2,287,270 | 6/1942 | Partridge | 264/248 X |
| 2,294,424 | 9/1942 | Roberts . | |
| 2,300,095 | 10/1942 | Bowers . | |
| 2,373,899 | 4/1945 | Lejeune . | |
| 2,422,979 | 6/1947 | Pecker . | |
| 2,453,143 | 11/1948 | Lejeune | 273/61 R |
| 2,684,106 | 7/1954 | Fegan . | |
| 2,832,094 | 4/1958 | Groth . | |
| 2,910,728 | 11/1959 | Rowe . | |
| 3,642,975 | 2/1972 | Duggins . | |
| 3,933,967 | 1/1976 | Taylor | 264/248 |
| 4,049,484 | 9/1977 | Priest . | |
| 4,151,029 | 4/1979 | Jones-Hinton . | |
| 4,222,806 | 9/1980 | Parker . | |
| 4,240,630 | 12/1980 | Hoffman . | |
| 4,248,658 | 2/1981 | McGlashen . | |
| 4,327,912 | 5/1982 | Hoffman . | |
| 4,568,081 | 2/1986 | Martin | 273/65 D |

FOREIGN PATENT DOCUMENTS

| | | |
|---|---|---|
| 436100 | 10/1935 | United Kingdom . |
| 628037 | 8/1949 | United Kingdom . |

OTHER PUBLICATIONS

A. C. Hoffman Engineering, Inc. Drawing, "Tennis Ball Bonding Cav." (dated 6/19/87).

*Primary Examiner*—Michael W. Ball
*Assistant Examiner*—Jeff H. Aftergut
*Attorney, Agent, or Firm*—Poms, Smith, Lande & Rose

[57] ABSTRACT

A method of making tennis balls by a single core part and fabric piece bonding step is disclosed wherein an assembly of core parts, including a pair of hemispheric core halves, and fabric cover pieces, including a pair of figure eight fabric dumbbells, are assembled to one another to a subassembly of core parts held together by a dried but uncured first curable cement, the fabric pieces are held about the core subassembly by a second dried but uncured cement and a third curable cement is provided between the fabric pieces to form the exterior ball seam. The assembly of core and cover parts and pieces thus held together by the tackiness of dried but uncured cements is then placed within a snugly fitting mold and cured in the presence of heat to bond the core parts to one another, the fabric cover pieces to the core and the fabric piece edges to one another to a completed ball. As a part of the method, one of the core parts is provided with an integrally formed one-way air valve so that the bonding step is accomplished on an unpressurized ball and the bonded ball is then subsequently pressurized by the application of exterior pressure which enters the interior of the ball through the one-way valve to pressurize the tennis ball to a desired bounce characteristic.

16 Claims, 5 Drawing Sheets

Fig. 1.
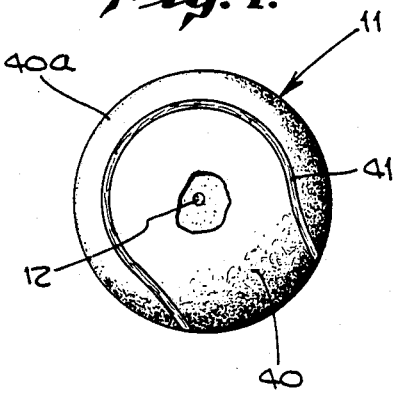
Fig. 3.
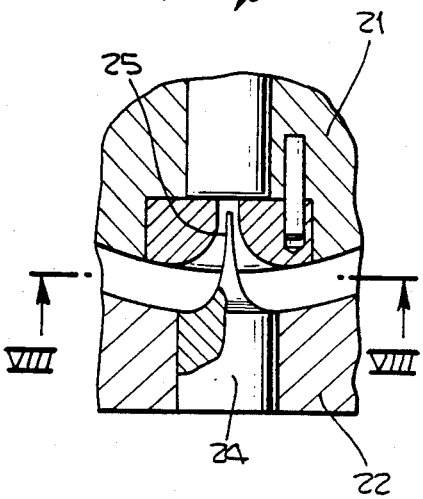
Fig. 2.
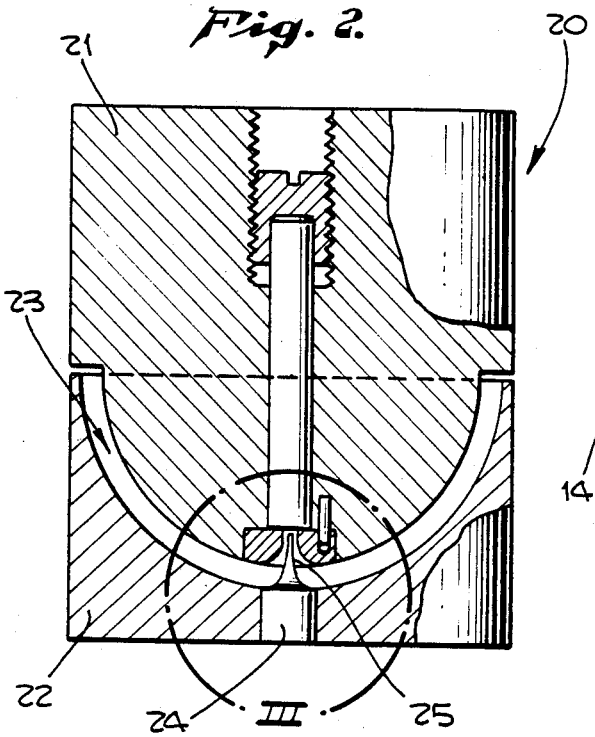
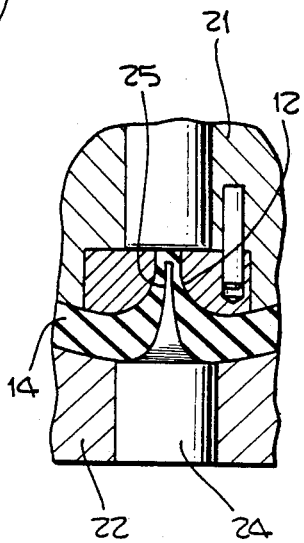
Fig. 4.

Fig. 11.
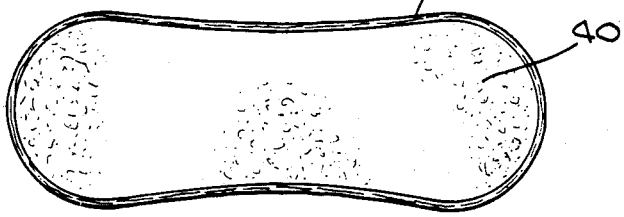
Fig. 13.
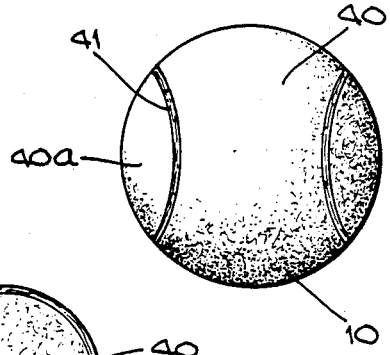
Fig. 12.
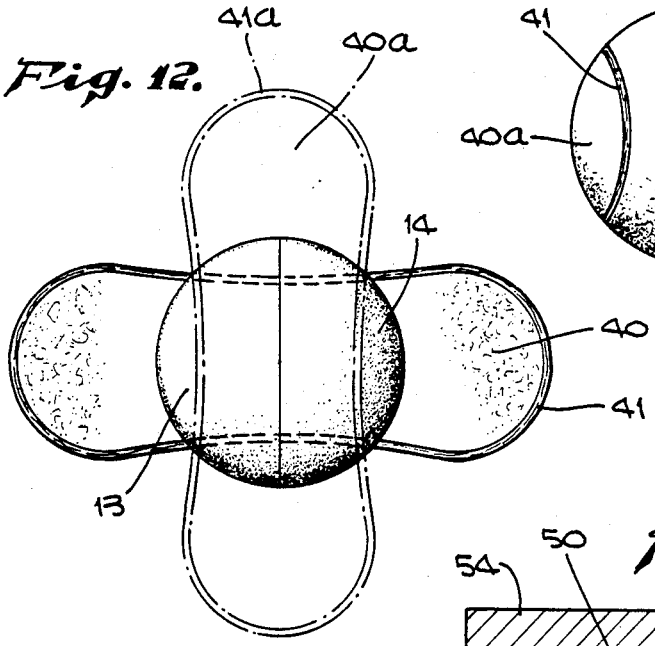
Fig. 14.
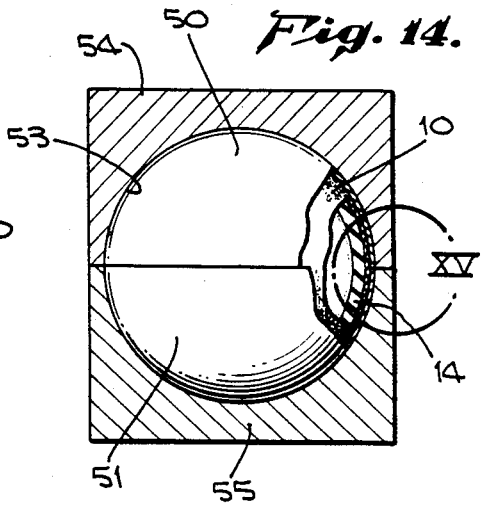
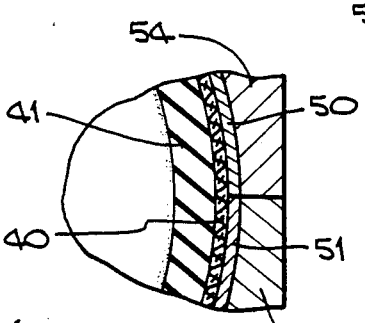
Fig. 15.

Fig. 16.
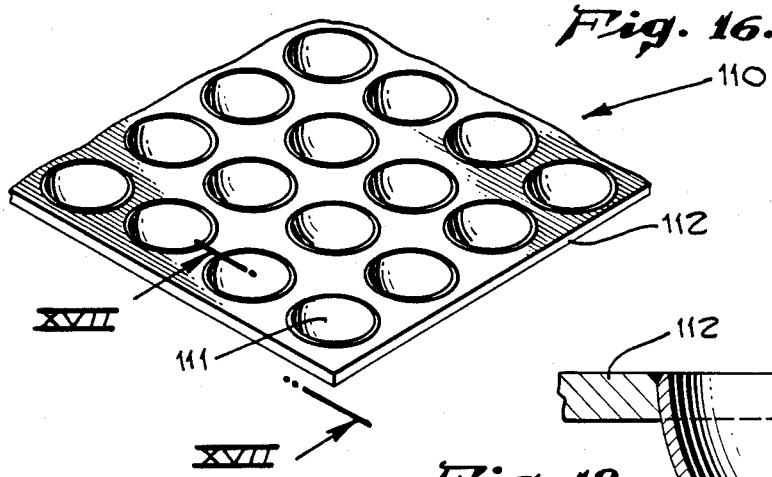
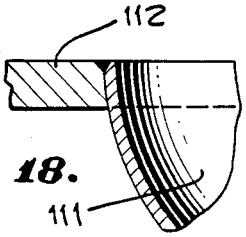
Fig. 18.
Fig. 17.
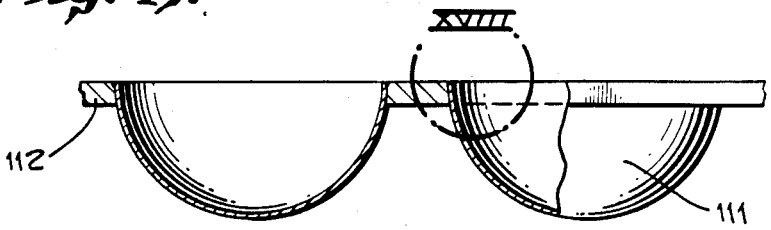
Fig. 19.
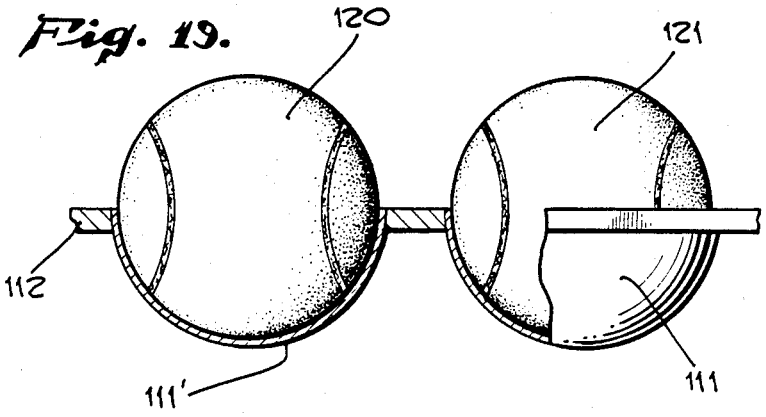

Fig. 20.
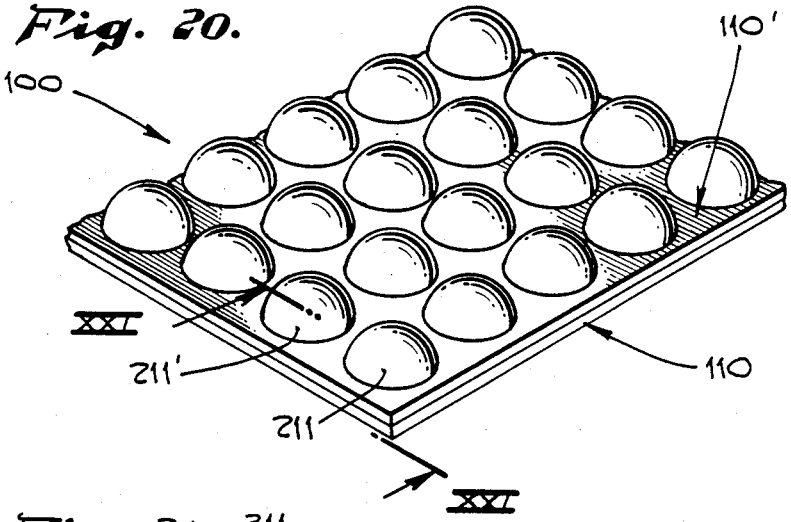
Fig. 21.
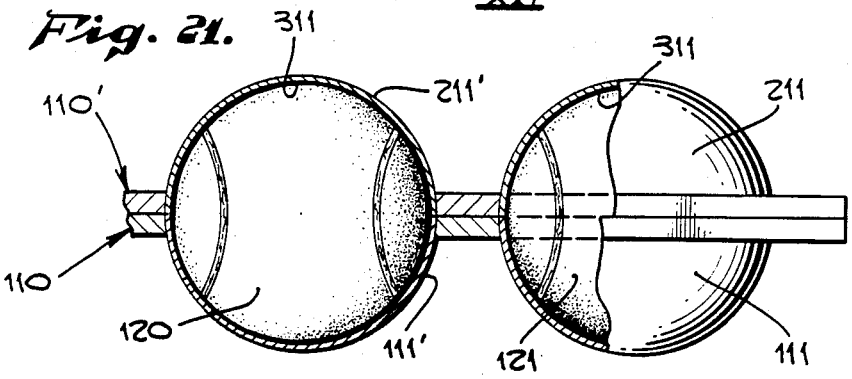
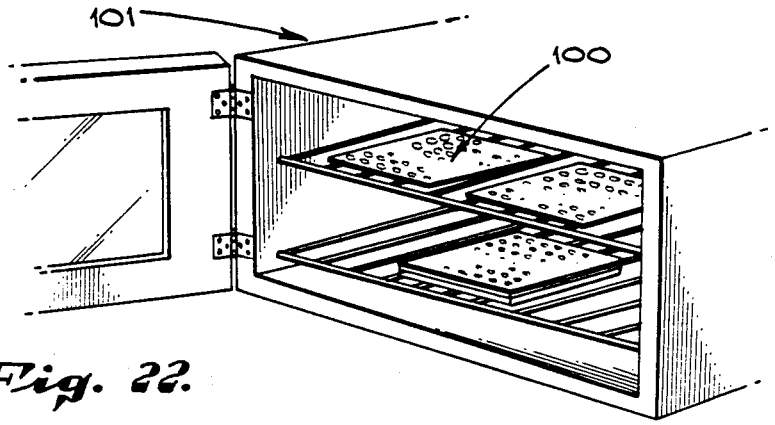
Fig. 22.

METHOD OF MAKING TENNIS BALLS OR THE LIKE

RELATED APPLICATIONS

This application is a continuation-in-part application based upon applicant's copending application Ser. No. 07/145,897, filed Jan. 20, 1988 and entitled "METHOD OF MAKING TENNIS BALL WITH A SINGLE CORE AND COVER BONDING CURE".

BACKGROUND OF THE INVENTION

The present invention relates to methods for making tennis balls and the like, and particularly to a method for bonding the tennis core and fabric cover pieces to one another through a single bonding step.

The art of manufacturing tennis balls has been well developed heretofore by such companies as Dunlop Rubber Company, Ltd., of London, England as shown by its U.S. Pat. Nos. 4,151,029 and 4,248,658 and Great Britain Pat. No. 436,100. The elastomeric core of a tennis ball is usually made of a vulcanized rubber molded into a pair of hemispherical rubber cups which are then adhered together by a heat curable cement. The core is heat treated to bond the hemispherical rubber cups to one another before the fabric cover is applied.

The manufacture fabric covers for tennis balls generally include the cutting of a sheet of fabric into "dumbbell" shapes, a pair of such fabric dumbbells being applied about the core to envelop it. The wide seam visible between the fabric dumbbells on a completed ball is provided by a suitable adhesive, usually a white rubber solution, which is applied to the edges of the fabric before the fabric is assembled to the core.

Fabric to core adhesives or cements are also well known in the art. Once the core has been completed, the core is dipped in the fabric to core adhesive or cement and then allowed to dry until the adhesive becomes tacky. The fabric dumbbell shapes are then applied manually or by automated equipment about the cores with the white cement between the fabric edges. This assembly is then subjected to a heat curing step whereby the fabric is bonded to the core and the edge seams are cured as well.

Since tennis balls are internally pressurized to provide a desired bounce characteristic, the core halves are assembled in a pressurized environment so that a suitable internal pressure, on the order to seventeen (13) pounds per square inch, is provided within the core during its initial manufacture. When the core is subjected to the adhesive heat curing step, the mass of air within the core tends to expand the core against the surrounding heat applying mold. It was thus necessary to allow the mold and core to cool sufficiently after a core curing step so that the core will not blow part under the elevated internal pressure caused by the heated mass of air contained therein. The core is also subjected to a second heating step when the fabric is bonded to the core.

It has come to my attention that it would be time saving and more economical to be able to assemble a tennis ball core and fabric cover in a completed assembly for a single cement curing step. As will be discussed more fully hereinafter, in order to accomplish a single step bonding method as disclosed hereinafter, the within method utilizes a core having a one-way air valve or check valve provided in the core as disclosed in my prior U.S. Pat. Nos. 4,240,630 and 4,327,912. As discussed in my prior patents the check valve formed integrally of the core provides for the introduction of air after completion of the manufacture of the tennis ball so that balls that lose their pressure, can be repressured.

It has also come to my attention that it would be more economical and easier, from a ball manufacturing standpoint, to be able to utilize lightweight molds and less expensive equipment in curing the adhesive to bond the ball core halves and fabric together.

SUMMARY OF THE INVENTION

With the foregoing in mind, it is the primary object of the present invention to disclose and provide a method of making tennis balls and the like wherein the ball core can be assembled from core parts with a fabric cover, of fabric pieces held in place about the core the thus provided assembly of core and cover parts being then bonded, one to another, in a single bonding step. Additional objects of the present invention are to provide such a method for making tennis balls and the like which is less time consuming than prior methods, allows for economies in automated manufacturing processes required for making tennis balls in large volume and which produces a pressurizable tennis ball in a convenient and facile manner which satisfies the specifications of U.S. Tennis Association for tennis balls acceptable for tournament play.

Generally stated, the present method of making internally pressurized tennis balls and the like includes the forming of a subassembly of core parts in normal atmospheric conditions at least one of which has a one-way air valve therein for subsequent introduction of a core pressurizing medium such as air, the core parts being held in such unpressurized assembly by the tackiness of a suitable dried but uncured first curable cement. Fabric pieces preferably of dumbbell shape, are then provided about the core and held in place by the tackiness of a suitable dried but uncured second curable cement provided between the pieces and core parts, the assembly thereof being an uncured and unpressurized ball assembly. The ball assembly is then subjected to a cement curing step whereby the cements between the core parts and between the fabric and core are cured, the ball assembly components being thus bonded to one another in a single step. Such curing step preferably comprises placing a plurality of ball assemblies in a lightweight multicavity, egg crate like, mold having a relatively thin walled construction when compared to conventional molds in use and simply heating the ball assemblies in such molds in a conventional air convection oven. Thereafter, a pressurizing medium such as is introduced into the core through the one-way air valve to provide a desired bounce characteristic for the ball to satisfy the bounce characteristics required for such balls by the U.S. Tennis Association.

More specifically, the present method includes the steps of premolding a pair of rubber cups or hemispherical core halves, at least one of which is provided integrally of the body thereof of a rubber one-way air valve structure. Any rubber flashing present from the premolding step is removed and exterior surfaces are surfaced ground to roughen the surfaces to facilitate subsequent cementing of fabric pieces thereto. A suitable curable cement is applied to the core halves in known manner by dipping the open end of each core half into the cement, the cement then being allowed to dry to a tacky uncured state. Two such halves are then capped to one another at atmospheric pressure, that is fitted to one another to form a ball, and are held in such unpressurized subassembly by the tackiness of the cement provided therebetween. The core is then dipped in a fabric adhesive curable cement in known manner and is allowed to dry again to a tacky, uncured state. A pair of fabric pieces of generally figure eight configuration are coated along their lateral edges with a suitable, curable cement in known manner and allowed to dry again to a tacky uncured state. The fabric pieces are then assembled around the ball core subassembly to provide a ball assembly of core parts and fabric pieces with the three cement applications holding the core halves to one another, the fabric pieces to the core and the fabric edges to one another and to the core, respectively. This uncured and internally unpressurized ball assembly is then placed within a suitable heat applying mold and is heated to a temperature, and for a time, to cure the cement so provided to bond the ball components to one another in a single bonding step.

In the preferred curing step of the present invention, the ball components are baked in a conventional heat convection oven for approximately twenty minutes at about three hundred-twenty degrees Fahrenheit (320° F.). The ball components, in assembled relation, are placed in stainless steel shells mounted in trays thereof on mounting plates, opposing shells on facing plates providing multiple cavities which hold the ball components in their assembled relation during the curing step in the oven. The pairs of facing plates are clamped together and placed within the convection oven for heating in an atmospheric pressure environment. After the curing step, the mold plates may be immediately separated, there being no excessive internal pressures in the cured balls.

Subsequently, the bonded ball assemblies are subjected to an above atmospheric external pressure of a pressurizing medium such as air in order to introduce such medium through the fabric cover and into the ball core via the one-way valve provided in at least one of the core halves. The fabric employed in tennis ball manufacturing is permeable to air and, while it overlies the valve in the core, it does not prevent the introduction of the pressurizing medium, which normally is air, into the core.

A more complete understanding will be afforded to those skilled in the art as to the present method for making internally pressurized tennis balls and the like from a consideration of the following detailed description of a preferred exemplary embodiment thereof. Reference will be made to the appended sheets of drawings which will first be described briefly.

BRIEF DESCRIPTION OF THE DRAWINGS

FIG. 1 is a plan view of a tennis ball made in accordance with the method of the present invention illustrating a pair of generally figure eight fabric dumbbells secured about an inner rubber core, the latter having a one-way air valve provided therein;

FIG. 2 is a vertical section view of an exemplary embodiment of mold for molding a core half, with a one-way air valve formed integrally thereof, for use in the method of the present invention;

FIG. 3 is an enlarged detail view of a portion of the mold of FIG. 2 taken therein in the air of III—III;

FIG. 4 is a view as in FIG. 3 with a rubber core half being molded within the mold;

FIG. 11 is a plan view of a fabric piece of generally figure eight or dumbbell configuration with a suitable cement applied the outer edges thereof, the fabric piece being utilized in the present method of making tennis balls and the like;

FIG. 12 is a somewhat schematic representation of how a pair of fabric pieces of generally figure eight or dumbbell configuration can be manually or automatically folded about a ball core to completely envelop the same;

FIG. 13 shows the fabric dumbbells and core of FIG. 2 when in assembled relation with a seam of uncured cement showing where the fabric edges generally abut;

FIG. 14 shows an exemplary heat applying mold enclosing a pair of hemispheric metal shells which snugly fit about and enclose the uncured ball assembly of FIG. 13 therein;

FIG. 15 is a detail view, in section, of a portion of the mold and ball assembly of FIG. 14 taken therein in the area of XV—XV;

FIG. 16 is a top view of a portion of a preferred exemplary embodiment of curing mold having a plurality of heat conductive shells provided in a shell-plate assembly thereof.

FIG. 17 is a section view through the mold half of FIG. 16 taken therein along the plane VII—VII.

FIG. 18 is a detail view, in section, of the mold half of FIG. 17 taken therein in the area designated XVIII;

FIG. 19 is a side view, partially in section, of a portion of the mold half of FIGS. 16 through 18 showing uncured tennis ball, or the like, assemblies positioned therein;

FIG. 20 is a top view of an assembled mold of two of the mold halves in accordance with FIGS. 16 through 18, assembled one to the other enclosing a plurality of individual uncured tennis balls, or the like, within facing shell of the mold half assemblies;

FIG. 21 is a section view of the mold of FIG. 20 taken therein along the plane XXI—XXI;

FIG. 22 is a somewhat schematic, perspective view of a conventional air convection type oven having a plurality of molds, as seen in FIG. 20, placed therein for a heating step to cure the tennis ball assemblies contained within the molds.

DESCRIPTION OF THE PREFERRED EXEMPLARY EMBODIMENT

As will now be discussed in detail, the present method in making an internally pressurized tennis ball, or the like, specifically contemplates a method of assembling the ball components, i.e. core parts, fabric parts, and suitable cements, in an unpressurized and uncured ball assembly, as generally indicated at 10 in FIG. 13 in such a manner that the bonding of the core parts to one another, the bonding of the fabric pieces to the core and the bonding of the fabric piece edges to one another can all be accomplished in a single bonding step in a suitable mold, as illustrated in FIG. 14, through the application of heat where a heat curable cement is employed. Such completed ball, made in accordance with the present invention, is illustrated generally at 11 in FIG. 1 and may be internally pressurized through the one-way valve 12 after completion of the ball assembly method. While I do not consider my invention to reside in the materials employed for the core parts, fabric pieces or cements, examples that I have used successfully in making operable tennis balls will be explained hereinafter. Also, it should be noted that the provision of a one-way air valve in the core of the tennis ball has been covered in detail in my prior U.S. Pat. Nos. 4,240,630 and 4,327,912, the disclosures of which are incorporated herein by reference.

In addition, a method of making an unpressurized core suitable for use in making tennis balls has been disclosed heretofore in my copending application for U.S. Pat. No. 07/105,662 filed Oct. 7, 1987 and entitled "METHOD OF MAKING A PRESSURIZED BALL", the disclosure of which is also incorporated herein by reference.

Tennis ball cores, as is known in the industry, are preferably made from a natural rubber. It is also common to make such cores out of a pair of opposing hemispherical core halves, as halves 13 and 14 in FIG. 9. As particularly contemplated within an aspect of the present method, at least one of the core halves 13 and 14 is provided with a one-way air valve 12 to facilitate the introduction of a ball pressurizing medium, such as air, after the ball has been completed. Such valve may be made with a core molding apparatus as generally seen at 20 in FIG. 2.

Figure 5:
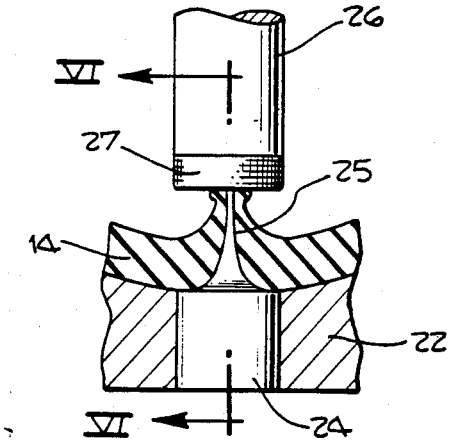
FIG. 5 is a view as in FIGS. 2, 3 and 4 showing the top half of the mold removed and a valve orifice forming step.
Figure 7:
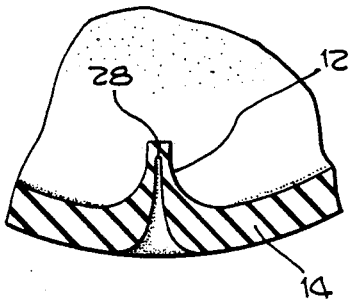
FIG. 7 is a detail section view of a portion of the ball of FIG. 1 showing the valve orifice following the orifice forming step illustrated in FIGS. 5 and 6.
Figure 6:
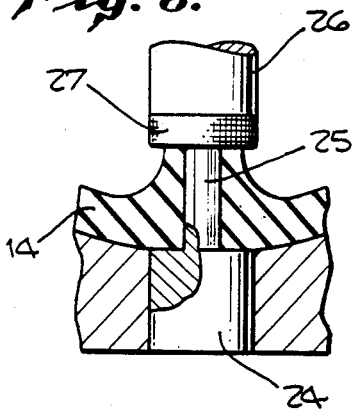
FIG. 6 is a section view taken in FIG. 5 along the plane VI—VI.
Figure 9:
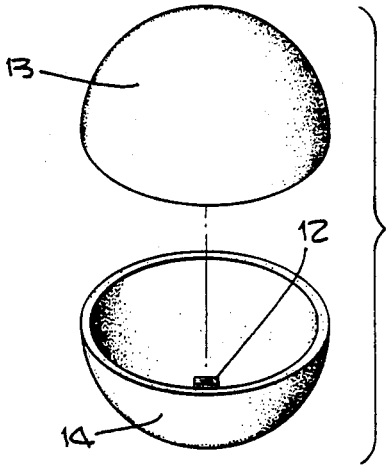
FIG. 9 is a perspective, exploded view of a ball core, comprising in the preferred embodiment to hemispherical core halves, used in the method of the present invention.
Figure 8:
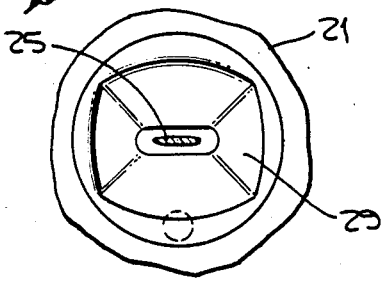
FIG. 8 is a plan view of the upper portions of the mold of FIG. 3 taken therein along the plane VIII—VIII.

Referring now initially to FIG. 2, a preferred exemplary embodiment of valved core half mold, indicated generally at 20, is provided with an upper cylindrical mold body 21 and a lower cylindrical mold body 22. Mold bodies 21 and 22 are partible relative to each other in order to provide for molding a core half in the mold cavity indicated generally at 23. As seen in detail in FIG. 3, a one-way valve is molded into the core half through the provision of a molding insert 24 having a thin upstanding blade portion 25. The core half 14 of FIG. 9 is shown in FIG. 4 during the molding process with the valve 12 being initially molded but not completed. After molding of the core half 14, the upper mold body 21 is removed and a cylindrical tool 26, having a fiber pad 27 on its lower end is directed downwardly toward blade 25 by suitable means, such as a drill press. As seen in FIGS. 5 and 6, the fiber pad 27 on tool 26 is pressed into engagement with blade 25, the sharp edged blade thereby penetrating the previously closed end of valve 12 to provide a valve orifice or slit as seen at 28 in FIG. 7. As seen in FIGS. 3, 4 and 8, the interior surface 29 of the upper mold provides a tapered side wall configuration for valve 12, the resultant being a valve which is urged into a closed condition by the pressure of air, or other pressuring medium, subsequently applied to the interior of the ball core.

As is generally known in the industry, the ball core halves are cleaned of any rubber flashing which might be left over from the molding operation and are surface ground on the exterior surface thereof in order to roughen the surface to facilitate the adhesive application of a suitable fabric cover as is normally employed in tennis balls. The core halves are then normally dipped in a suitable curable cement and then bonded to one another with a desired internal pressure before the application of a fabric cover in most prior art methods. However, as particularly contemplated within the present method, the premolded and preground core halves 13 and 14 of FIG. 9 are edge dipped in a suitable first adhesive, and the adhesive is allowed to dry to a tacky, but uncured state, and the halves are assembled together in an unpressurized state.

While the adhesives and/or cements employed for bonding cores together are well known in the tennis ball manufacturing art, the formula employed for a first cement employed in the present method for joining the ball cores together comprises the following:

1. FORMULA FOR FIRST CEMENT:

| INGREDIENT | PPH |
|---|---|
| #1RSS | 100 |
| Zinc Oxide | 5 |
| Stearic Acid | 2 |
| Wingstay L | 0.5 |
| Pepton 44 | 0.3 |
| Zeolex 23 | 30 |
| Cumar R-16 | 2 |
| Reogen | 2 |
| Titanium Dioxide | 2 |
| Spider Sulfur | 3 |
| MBTS | 1 |
| DOTG | 0.75 |

Wherein #1RSS is number 1 ribbed smoke sheet natural rubber as is known in the industry, Wingstay L is P-Cresol and Dicyclopentadiene, Pepton 44 is Dithiobisbenzanilide, and Zeolex 23 is Silica pigment. This mixture is then dissolved in a "toluene" solvent in the ratio of 750 grams of material to 2400 ml of toluene. The drying time, as for a typical core bonding cement, is in the area of 30 to 45 minutes.

Since the valve 12 is formed of natural rubber, it is desirable to grease the valve with a silicone dielectric such as "DC 4 compound" sold by Dow Corning Corporation of Midland, Mich. which meets military specification MIL-S-8860B, Amendment 0.3, or the equivalent, to prevent surfaces of the slit opening of the rubber valve halves from adhering to themselves in an inoperative manner as the result of the subsequent cement curing step. The grease may be applied manually or automatically into the valve and particularly into the orifice or slit 28 so that the rubber parts do not come in to contact with one another during subsequent cement bonding operation.

Figure 10:
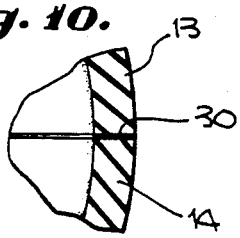
FIG. 10 is a detail view, in section, of a portion of the ball core showing a layer of adhesive between the core halves where they generally abut one another when assembled into a ball like configuration.

With the core halves thus assembled and treated, they are capped by being placed into juxtaposition against one another and are held together, in accordance with the present method, by the tackiness of the dried, but uncured first curable cement discussed. In "capping", the putting of the core halves 13 and 14 together, the core parts are simply assembled together at atmospheric pressure so that the tackiness of the first curable cement as seen at 30 at the parting line between the halves 13 and 14 in FIG. 10, holds the thus unpressurized core together.

In preparation for applying of the cover to the ball core subassembly, the core subassembly is dipped in a fabric adhesive and allowed to dry approximately 45 minutes so that the fabric adhesive is tacky, but uncured. While such fabric to core adhesives or cements are very well known in the art, the formula for a second cement used in an actual embodiment of the present method comprised the following:

| INGREDIENT | PPH |
|---|---|
| #1RSS | 100.0 |
| Zinc Oxide | 3.0 |
| Stearic Acid | 1.5 |
| Wingtak | 5.0 |
| MBTS | .0.5 |
| DOTG | 0.4 |
| Sulfur | 2.0 |

wherein 1RSS is number 1 ribbed smoke sheet natural rubber, Wingtak is Hydrocarbon Resin, MBTS is Mercaptobenzothiazole Disulfide and DOTG is Diorthotolylguanidine. The material thus formulated is then mixed on the ratio 750 grams of material with 2400 ml of Toluene, the mixture was then being shaken for 4 hours. The fabric to ball cement is applied to core subassemblies by dipping such assemblies and then allowing them to sit at room temperature and ambient pressures for a drying time about 45 minutes. It is desirable to allow the curable cement employed to reach a tackiness which will allow assembly of the fabric pieces thereto as discussed hereinafter.

Referring now to FIG. 11, it is well known in the industry that tennis ball fabric may be employed in the form of figure eight or "dumbbell" pieces such as fabric dumbbell 40 as seen in FIG. 11. Such fabric dumbbells may be obtained from Globe Albany Corporation of Albany, Me. They are ordinarily made of a combination of wool, cotton and nylon as known in the art. As is also known in the industry, it is common to dip a stack of such fabric dumbbells into a heat curable cement in order to coat the exterior edges of the fabric so that when the fabric is ultimately assembled around the ball core, there will be an edge to edge bond between the fabric dumbbells. Such fabric edge cement is seen at 41 in FIG. 11. The drying time for a suitable fabric edge fabric is about one hour. While these cements are well known in the industry, and each manufacture may have its own preferred compound, in an actual embodiment made in accordance with the present invention, the following formula therefore was employed:

| INGREDIENT | PPH |
|---|---|
| #1RSS | 100.0 |
| Zinc Oxide | 3.0 |
| Stearic Acid | 1.5 |
| Iceburg Clay | 50.0 |
| $TiO_2$ | 30.0 |
| MBTS | 0.5 |
| DOTG | 0.4 |
| Sulfur | 2.0 |

Wherein 1RSS is number 1 ribbed smoke sheet natural rubber, MBTS is Mercaptobenzothiazole Disulfide and DOTG is Diorthotolylguanidine. The above mix of material was then mixed with Toluene in the amounts 750 grams of material to 600 ml of Toluene, the mixture thereof being shaken for 4 hours. The edge cement can be painted onto the edges of the individual fabric dumbbells 40 manually if desired, but in mass production operations, as is well known in the industry, the fabric is provided in stacks of 20 or more pieces which are dipped together into the cement.

The precut fabric dumbbells 40 with a preapplied uncured fabric edge cement 41 applied thereto may then be assembled around the ball core subassembly, as seen in FIG. 12, by manual or automated means as are both well known in the art. A pair of such fabric dumbbells 40 and **40*a*, having edge cement 41 and 41*a* are illustrated in FIG. 12 positioned about the ball core halves 13 and 14 ready to be formed into an enveloping relationship as seen in FIG. 13, the seams 41 seen on the ball assembly of FIG. 13 being provided by the dry but uncured edge seam 41**.

In accordance with the present method, the internally unpressurized and uncured ball assembly, as seen in FIG. 13, which comprises the two rubber core halves 13 and 14 held together by the tackiness of a first cement, the pair of fabric dumbbells 40 and **40*a* being held to the core subassembly by the tackiness of a second fabric to ball cement and the fabric edge to edge seam being filled by a fabric edge cement, is then placed with a pair of snugly surrounding metal hemispheric shells 50 and 51 as seen in FIG. 14. In an actual embodiment in accordance with the present method, the metal shells 50 and 51** were provided within an internal diameter of 2.60 inches. In such actual embodiment, the ball assembly had an outside diameter of 2.610 inches the resultant affect being a snug fit of the ball assembly within the shells, the fabric surface of the ball assembly being somewhat compressible within the shells. The shells and ball assembly were then placed within a heat applying mold whereby heat was applied at 310° F. for ten minutes to cure the three cement bonds desired. Importantly, at the end of the ten minute mold cure, no cool down time was required and it was possible to remove the ball immediately.

Referring now to FIG. 14, as particularly contemplated within the present method, the ball assembly 10 of FIG. 13 is shown snugly fit within the shells 50 and 51 and placed within a conforming mold cavity 53 of a heatable mold having an upper body 54 and a lower body 55. It is not necessary that the mold bodies 54 and 55 compress or pressure the shells 50 and 51, but merely that they be maintained closed during the curing operation so as to prevent the shells 50 and 51 from separating under the internal pressure of atmospheric air present within the core halves 13 and 14. There of course is some room within the shells 50 and 51 for expansion of the core halves, by virtue of the compressibility of the fabric, as fabric 40 in FIG. 15, which is positioned about the core halves within the shells. Since the ball core is not prepressured to provide for a desire bounce characteristic of the ball being manufactured, the internal pressures within the heating mold of FIG. 14 are greatly reduced.

In an acceptable curing method, the ball assemblies as illustrated in FIG. 13 may be heated in a heating mold, comparable to that of FIG. 14, for a period of 10 minutes at a temperature of approximately 310° F. in order to cure the cements normally used in manufacturing tennis balls and particularly the cements disclosed herein. It is not necessary to allow for a cool down time of the ball assembly after the curing step is completed. The mold may be opened immediately following the 10 minute curing step and the completed tennis balls may be removed from the shells and allowed to sit in ambient temperature and pressure conditions. As is known in the art, it is common to steam and tumble such finished balls to obliterate any parting seam which might be left by the heating mold on the ball exterior fabric.

Referring now to FIGS. 16 through 22, a preferred exemplary embodiment of method of curing the tennis ball assemblies will now be disclosed. It has come to my attention heretofore that the typical heavy, thick steel molds used in the tennis ball manufacturing industry are quite expensive and difficult to manipulate easily in making tennis balls. With the availability of my within method of making tennis ball assemblies of core halves, fabric covers and uncured adhesives, I have developed in association therewith the present exemplary embodiment of light weight tennis ball curing mold, as seen generally at 100 in FIG. 20 which can be simply placed within a conventional air convection heating oven, indicated generally at 101 in FIG. 22 to cure the adhesives. Since the tennis ball assemblies are not pre-pressurized, the mold employed in curing the same need not comprise a heavy steel body as in prior conventional molding operations.

Referring now to FIG. 16, the mold of the present method comprises two mold halves, one of which is indicated generally at 110. As is also seen in FIGS. 17 and 18, the mold half may comprise a plurality, up to as many as 100 or more, shells such as the shell 111, which are of hemispherical configuration. Each shell, as shell 111, is preferably made of a light weight stainless steel material on the order of 10 to 15 thousandth of an inch thick. The individual shells may be formed by a stamping, metal molding or preferably spinning process to achieve a hemispherical shape as illustrated. Each shell, as shell 111, is preferably assembled to a mounting plate, as plate 112 in FIG. 16, and secured thereto, as by braising or welding the two together. Such assembly of shells and mounting plate produces a somewhat egg crate like construction when two mold halves, as mold halves 110 and 110', are assembled together as seen in FIG. 20. The mounting plates, as plate 112, are preferably made of a medium weight steel sheet on the order of approximately ¼ inch thickness. While as many as one hundred mold cavities may be provided in such a mold, for purposes of the present disclosure, the mold is illustrated with a fewer number of cavities.

In accordance with the present method of curing, a plurality of uncured tennis ball assemblies, such as ball assemblies 120 and 121 in FIG. 19, are placed within the associated shells 111 and 111', the latter being provided so as to receive the ball assemblies in a snug fit therein. A mating, identically formed mold half is then seated over the ball assemblies as seen in FIGS. 20 and 21. The ball assemblies are held snugly within the cavities provided by the mating shell halves, such as shells 111 and 211 provide cavity 311 in FIG. 21, the other plurality of cavities being similarly formed as seen in part by the provision of cavity 311' formed by shell 111' and 211' as in FIG. 21. Thereafter, the tennis ball assemblies and facing mold halves, indicated generally at 110 and 110', may be clamped together by suitable clamp means and placed within a conventional oven as indicated at 101 in FIG. 22. Preferably, the assembly of balls and mold halves is at atmospheric pressure within the oven at a temperature of at least 320 degrees Fahrenheit for at least twenty minutes. I have found that extending the heating time does not detract from the acceptable characteristics of the tennis balls made thereby. On completion of the heating step, I have also found that the molds may be immediately opened since the tennis ball assemblies do not have an excessive amount of internal air pressure, since the assemblies are not prepressurized in accordance with the present method. Such unpressurized tennis balls may then be subjected to an air pressure elevated environment whereby internal air pressure is increased to a desired amount.

As is also particularly contemplated within the present invention, and as one of the advantages of the present method, tennis balls made in accordance with the method described thus far may then be pressured by the introduction of a pressuring medium into the interior of the ball through the one-way valves, as valve 12 in core half 14, the valve being beneath the surface of the air permeable fabric dumbbell, as dumbbell 40 in FIG. 1. The ball assemblies with the fabric completely covering them may be simply placed in an enclosed chamber which can be pressurized. I have found that a ball assembly made in accordance with the present method, utilizing natural rubber compound for the ball core and the fabric mentioned herein can be given an internal pressure of seventeen pounds per square inch through the application of an external pressure of approximately twenty pounds per square inch. As is established in the U.S. Tennis Association specifications, it is required that the ball rebound between 53 and 58 inches when dropped from a height of 69 inches. I have found that balls made in accordance with my present method consistently produce a bounce in the 55 to 57 inch range when pressured by 20 psi externally and comply in every way with U.S.T.A. specifications.

Having thus described a preferred exemplary embodiment of the method of making tennis balls and the like in accordance with the present invention, it should now be apparent to those skilled in the art that the aforestated objects and advantages for the present invention have been attained. Those skilled in the art should also appreciate that various modifications, adaptations and ramifications of the present method of making a pressurized tennis ball and the like may be accomplished within the scope of the present invention which is defined by the following claims.

I claim:

1. A method of making internally pressurized tennis balls and the like which include an assembly of core parts and fabric cover pieces bonded together by suitable curable cements comprising the steps of:

providing a subassembly of core parts, at least one of which has a one-way air valve therein for subsequent introduction of a core pressurizing medium such as air, in the form of an internally unpressurized ball shaped core and holding said subassembly of core parts together by the tackiness of a suitable, dried but uncured, first curable cement provided between said parts;

applying fabric pieces about said core subassembly to provide a fabric cover thereabout and holding said fabric pieces to said core subassembly by the tackiness of a suitable, dried but uncured, second curable cement provided between said pieces and said core parts, thus providing an uncured and unpressurized ball assembly;

containing said ball assembly within a heat conductive shell at atmospheric pressure, wherein said step of containing said ball assembly within a heat conductive shell at atmospheric pressure comprises the substeps of:

forming a plurality of hemispherical shell halves of lightweight metal material on the order of 10 to 15 thousandth of an inch thick, mounting said plurality of shell halves on two or more separate mounting plates having a thickness on the order of ¼ inch to provide an egg crate like pair of facing plates having facing shell halves to contain a ball assembly between facing pairs thereof;

heating said shell and ball assembly until said cements are cured; removing a ball assembly from its associated shell halves immediately following the completion of said heating step; and thereafter introducing a pressurizing medium such as air into said bonded ball assembly through the one-way air valve provided therein.

2. The method of making internally pressurized tennis balls and the like as in claim 1 comprising the additional steps of:

providing a suitable, dried but uncured, third curable cement between generally abutting edges of said fabric pieces; and bonding said generally abutting edges of said fabric pieces to each other by said single cement curing step.

3. The method of making internally pressurized tennis balls and the like of claim 1 wherein said steps of bonding further includes the substeps of:

placing said uncured ball assembly within a pair of hemispherical metal shells which snugly fit about said uncured and internally unpressurized ball; and applying heat externally to said ball assembly within said shells while said shells are held together about said assembly to cure the cements therein.

4. The method of making internally pressurized tennis balls and the like of claim 1 wherein said step of providing a subassembly of core parts includes the substep of:

providing said core parts as two hemispherical core halves, each being made of rubber and having been premolded, cleaned of any mold flashing and having been surfaced ground externally to facilitate the cementing of a fabric cover subsequently thereabout.

5. The method of making internally pressurized tennis balls and the like of claim 1 wherein said step of providing a subassembly of core parts, at least one of which has a one-way air valve therein for a subsequent introduction of a core pressurizing medium such as air, includes the substep of:

premolding said one-way air valve of rubber integrally of a rubber core part in which it is provided.

6. The method of making internally pressurized tennis balls and the like of claim 5 wherein said step of premolding said one-way air valve includes the substep of:

applying a lubricant medium into said valve to preserve the operability of said rubber valve through the subsequent cement bonding step.

7. The method of making internally pressurized tennis balls and the like of claim 1 wherein said step of applying fabric pieces about said subassembly comprises the substep of:

providing said fabric pieces as a pair of generally figure eight fabric dumbbells which together envelop said core subassembly when provided in a mating array thereabout.

8. The method of making internally pressurized tennis balls and the like of claim 1 wherein said bonding step includes the substeps of:

placing said uncured and unpressurized ball assembly within a surrounding mold which snugly surrounds the same;

applying heat through said mold to said assembly to heat and cure the cements previously provided.

9. The method of making internally pressurized tennis balls and the like of claim 1 wherein said step of introducing a core pressurizing medium such as air into said balls comprises the substeps of:

completing the bonding step for a plurality of ball assemblies;

placing said plurality of ball assemblies together in a pressurizable chamber; and pressurizing such chamber to a desired predetermined ball exterior pressure to produce a lower, predetermined, ball internal pressure.

10. The method of making tennis balls and the like of claim 1 wherein said step of heating said shell and ball assembly until said cements are cured comprises the substeps of:

providing an air convection heating oven capable of providing a heating environment of at least three hundred twenty degrees Fahrenheit at atmospheric pressure; and placing said pair of facing plate containing at least one said ball assembly in said oven and heating the same until said cements are cured.

11. The method of making internally pressurized tennis balls and the like of claim 1 wherein:

said pair of hemispherical metal shells are mounted as part of an array thereof in a pair of metal mounting plates; and said step of applying heat externally to said ball assembly includes the substep of placing said mounting plates with said ball assembly within opposing shells of said plates within an air convection heating oven.

12. The method of making tennis ball and the like of claim 11 wherein said step of applying heat includes the substep of heating the contents of said oven to approximately three hundred twenty degrees Fahrenheit for approximately twenty minutes to cure said cements.

13. A method of making internally pressurized tennis balls and the like which includes an assembly of core parts and fabric cover pieces bonded together by suitable curable cements comprising the steps of:

providing a plurality of subassemblies of core parts, each of said assemblies having at least one one-way air valve therein for subsequent introduction of a core pressurizing medium such as air and being in the form of an internally unpressurized ball shaped core;

applying fabric pieces about each said core subassemblies to provide a fabric cover thereabout;

forming a plurality of hemispherical shell halves of lightweight metal material on the order of 10 to 15 thousandth of an inch thick;

mounting said plurality of shell halves on two or more separate mounting plates having a thickness on the order of ¼ inch to provide an egg crate like pair of facing plates having facing shell halves to contain a ball assembly between facing pairs thereof;

containing each of said ball assemblies within a pair of facing shell halves at atmospheric pressure;

heating said plates, shell halves and ball assemblies to cure heat curable cements applied to said assemblies removing the ball assemblies from their associated shell halves immediately following the completion of said heating step; and thereafter introducing a pressurizing medium such as air into said ball assemblies through the one-way air valves provided therein.

14. The method of making tennis balls and the like of claim 13 wherein said step of heating comprises the substeps of:

providing an air convection heating oven capable of providing a heating environment of at least three hundred twenty degrees Fahrenheit at atmospheric pressure; and placing said pair of facing plates containing a plurality of said ball assemblies in said oven and heating the same until said cements are cured.

15. The method of making internally pressurized tennis balls and the like of claim 13 wherein:

said hemispherical shell halves are mounted as part of an array thereof in each of a pair of metal mounting plates; and said step of applying heat includes the substep of placing said mounting plates with said ball assemblies within opposing shells of said plates within an air convection heating oven.

16. The method of making tennis ball and the like of claim 15 wherein said step of applying heat includes the substep of heating the contents of said oven to approximately three hundred twenty degrees Fahrenheit for approximately twenty minutes to cure said cements.

* * * * *